US006440013B1

(12) United States Patent
Brown

(10) Patent No.: US 6,440,013 B1
(45) Date of Patent: Aug. 27, 2002

(54) PITCHING MACHINE

(76) Inventor: Harvey B. Brown, 42475 Osgood Rd., Fremont, CA (US) 94539

( * ) Notice: Subject to any disclaimer, the term of this patent is extended or adjusted under 35 U.S.C. 154(b) by 0 days.

(21) Appl. No.: 09/524,885

(22) Filed: Mar. 14, 2000

(51) Int. Cl.[7] ..... A63B 69/00; F41B 15/00

(52) U.S. Cl. ..... 473/422; 473/415; 124/6; 124/78

(58) Field of Search ..... 473/422, 451, 473/460, 431, 432, FOR 102, FOR 103, FOR 107, FOR 196; 273/317.2, 317.7; 124/7, 78, 6, 34; 198/817, 818

(56) References Cited

U.S. PATENT DOCUMENTS

| | | | | | |
|---|---|---|---|---|---|
| 2,112,611 | A | * | 3/1938 | Snippen | 124/78 |
| 2,918,915 | A | * | 12/1959 | Doeg | 124/78 |
| 3,604,409 | A | * | 9/1971 | Doeg | 124/78 |
| 3,777,732 | A | * | 12/1973 | Holloway et al. | 124/78 |
| 3,785,358 | A | * | 1/1974 | D'Angelo et al. | 124/78 |
| 3,794,011 | A | * | 2/1974 | Newgarden, Jr. | 124/78 |
| 3,844,267 | A | * | 10/1974 | Mohr | 124/78 |
| 4,086,903 | A | * | 5/1978 | Scott | 124/78 |
| 4,583,514 | A | * | 4/1986 | Nozato | 124/78 |
| 4,823,763 | A | * | 4/1989 | Ponza | 124/78 |
| 4,922,885 | A | * | 5/1990 | Iwabuchi et al. | 124/78 |
| 5,046,476 | A | * | 9/1991 | Nozato | 124/78 |

OTHER PUBLICATIONS

Athletic Training Equipment Company, Baseball and Softball Equipment Catalog, Catalog, 1994, USA.
Jugs Company, 1998 Catalog, Catalog, 1998.

* cited by examiner

*Primary Examiner*—Paul T. Sewell
*Assistant Examiner*—Mitra Aryanpour
(74) *Attorney, Agent, or Firm*—Gregory Scott Smith & Associates

(57) ABSTRACT

An improved pitching machine is provided. The invented pitching machine may be capable of consecutively throwing balls that each have a different predetermined trajectory, rotational velocity, and velocity, without resetting the machine. The machine may be capable of simulating a pitch sequence, as thrown by a pitcher in a game situation, which may effectively train batters. The machine includes a pair of rotating belts that are vertically spaced and extend parallel to each other and generally horizontally. Once a ball is seized between the belts, the ball is rapidly conveyed by the belts and thrown in a predetermined direction and at a selected velocity. The velocity of the belts may be independently adjusted for imparting a predetermined rotational velocity on balls conveyed by the belts, for throwing balls of different predetermined trajectories. A control system is provided for selecting a pitch type for each ball thrown by the machine. The control system is used to select the velocity of each belt and horizontal and vertical inclination of the belts to enable the machine to throw balls of selected pitch types. The control system can be activated between each ball thrown, so that each consecutive ball thrown may have a different pitch type.

20 Claims, 7 Drawing Sheets

21

PITCHING MACHINE

BACKGROUND OF THE INVENTION

1. Field of the Invention

The present invention relates generally to devices used to propel balls, and more particularly, to a pitching machine that can make dynamic pitch changes in real-time and that significantly reduces deterioration typically suffered by the balls used in such machines.

2. Description of Related Art

Pitching machines are well known in the prior art. Pitching machines have long been used for propelling, or throwing spherical balls, such as baseballs, softballs, and tennis balls for example, or oval balls such as a football. Primarily pitching machines are used for throwing baseballs and softballs during activities such as batting practice, where the pitching machine is used to simulate a human pitcher. Modern pitching machines can effectively throw most pitch types thrown by today's pitchers including fastballs, curveballs, sliders, knuckle-balls, and change-ups.

However, known pitching machines require setup for each type of pitch thrown, and must be reset for each different pitch type desired to be thrown to the batter. For instance, if it is desired to throw fastballs to a batter, the pitching machine is setup to throw fastballs. When it is desired to throw another type of pitch to the batter, such as curveballs, the machine is stopped and then re-sets for throwing balls of the new pitch type.

Another disadvantage of known pitching machines is that there is a substantial time delay between throwing different type pitches, due to the time required for resetting the machine. A more important disadvantage, is that the batter knows exactly what type of pitch is being thrown and can adjust their swing and stance for the anticipated speed and location of the pitch. In a game situation, the batter must be prepared for any type of pitch that may be thrown by the pitcher. Thus, pitching machine capable of consecutively throwing different type pitches, without requiring re-setup for the different type pitches to effectively simulate a game situation, would be advantageous over the prior art.

Known pitching machines include a pitching assembly that is supported by a base that may be a tripod or other suitable configuration. The pitching assembly may be coupled to the base such that the pitching assembly may pivot, or swivel, about on the base.

The pitching assembly typically includes a motor that may drive at least one ball throwing wheel. In a first common embodiment, one ball throwing wheel is provided for propelling, or throwing, balls. A fixed pad may be positioned adjacent to a confronting surface of the wheel to form a constricting space therebetween. A ball infeed chute may be coupled to the pad and is positioned to deliver the ball into the constricting space. The motor rotates the wheel at a desired speed to propel, or throw, the ball therefrom at a selected velocity. When a ball is placed in the infeed chute, the ball is momentarily seized between the pad and rotating wheel. The confronting surface of the rotating wheel instantly draws the ball across the pad and propels the ball in a desired direction and at the selected velocity. The line on which the ball is propelled between the pad and wheel is adjustable about a horizontal axis and the speed of the wheel is variable to adjust the trajectory of the thrown ball. Thus, the pitching assembly can be adjusted for throwing balls higher or lower and closer to, or farther from, a desired object such as a batter.

In another common embodiment, the pitching assembly includes a pair of throwing wheels spaced a distance apart and mounted on a base for axial rotation in a common plane. The space between the confronting surface of the wheels is less than the diameter of a ball to be thrown. A first wheel is rotated in a first direction, such as clockwise and a second wheel is rotated in an opposing direction, such as counter-clockwise. The ball infeed chute is mounted for rotational adjustment about the ball projecting line between the spaced wheels for rotational adjustment about the ball projecting line between the spaced wheels. This maintains the infeed chute in a gravity feeding position irrespective of the angular disposition of the common plane of the ball projecting wheels. When a ball is placed in the infeed chute, the ball is momentarily seized between the two rotating wheels and thrown in the desired direction.

Electrical controls are provided for controlling the rotational speeds of the two coacting wheels. The controls may be adjusted to enable the pitching assembly to throw different types of pitches. The controls may comprise potentiometers, or other known means, to independently vary the rotational speed of each wheel. Rotating each wheel at a different speed causes balls thrown thereby to have curvilinear trajectories. A variety of different ball throwing wheels have been tried.

A disadvantage of known pitching assemblies, and in particular, their ball throwing wheels is that they are somewhat destructive to baseballs used in the machines. Since the balls are abruptly seized by the confronting surfaces of the ball throwing wheels or the fixed pad, the balls tend to be abraded during use. Thus, the life span of baseballs used by prior art pitching machines may be substantially reduced. Furthermore, the delivery of a ball to the strike zone from a standard pitching distance can vary by more than 4 to 10 inches from one pitch to the next. There are a number of possible sources of inaccuracy. For example, a slight out of balance on one wheel, a variation in hardness between the wheels, and the alignment of the stitches on the ball when the ball contacts the wheel, are some of the possible sources of error inherent in the design of pitching wheel machines.

Thus, there exists a need for a pitching machine that is capable of accurately consecutively throwing different type pitches, without requiring manual resetting of the machine between different pitch types, that can switch pitch types relatively quickly, and that does not significantly reduce the life span of baseballs used in the machine.

SUMMARY OF THE INVENTION

The present invention comprises an improved device for propelling, or throwing balls in a desired trajectory and at a selected velocity, commonly known as a pitching machine. The pitching machine of the present invention is capable of consecutively propelling, or throwing balls, each ball having a different predetermined trajectory, rotation, and velocity that characterize a desired kind of pitch, without resetting the machine. The pitching machine is capable of consecutively, and in any desired order, throwing several balls having different known pitch types including fastballs, curveballs, sliders, knuckle-balls, and change-ups, without resetting the machine and without unnecessary time delay therebetween.

The pitching machine may be capable of simulating a pitch sequence, a number of balls thrown with each ball potentially having a different pitch type (different trajectory, rotation, and velocity), as if thrown by a human pitcher during an at-bat in a game situation. During an at-bat in a game, a batter does not know what type of pitch is being thrown and cannot pre-adjust their swing and stance for an anticipated speed, trajectory, and location of the pitch. Since the invented pitching machine is capable of consecutively throwing balls of different pitch types, without requiring resetting therebetween, the invented machine may be capable of more effectively training batters, as compared to prior art pitching machines.

The pitching machine of the present invention comprises a pitching assembly that may be pivotably coupled to a base. The base may be a tripod, or other appropriate configuration that supports the pitching assembly a desired distance above the ground.

The pitching assembly includes a ball throwing assembly coupled to a support plate. The ball throwing assembly may comprise a pair of belt assemblies that are vertically spaced and extend generally horizontally along the support plate and are coupled thereto. Each belt assembly may comprise a front pulley and a rear pulley and a belt that extends around both pulleys and generally horizontally along the plate. Each belt assembly may additionally include a motor that may drive, or rotate, at least one pulley at a desired speed for rotating the belt coupled to the pulley. Thus, a pair of vertically spaced belts that rotate generally horizontally along the support plate for propelling or throwing balls are provided by the invented ball throwing assembly. The use of two roughly parallel belts allows may reduce the number of potential sources of inaccuracy, compared to other kinds of pitching machine designs.

A ball infeed chute is positioned adjacent to the rear pulleys of the belt assemblies. The infeed chute has an outlet positioned to dispose balls info the space between the two rotating belts. When a ball is placed in the infeed chute, the ball falls through the outlet of the chute and is seized between the two rotating belts. The ball is rapidly conveyed by the rotating belts toward the front pulleys. Once the ball reaches the front pulleys, the ball is propelled, or thrown in a predetermined direction and at a selected velocity.

Conveyance of the ball by the belts, as opposed to momentarily seizing the ball between two rotating wheels or between a rotating wheel and a fixed pad, may reduce wear on balls used by the invented machine and increase the life span of the balls. Additionally, since balls are conveyed by the belts for a brief time period, as opposed to being momentarily seized between two wheels, the balls may be more accurately thrown toward a desired target. The rotational speed of the two spaced belts may be independently adjusted for imparting a desired rotation on balls. As the baseballs are conveyed for a brief time by the two rotating belts, it may also be possible to accelerate the baseball over the period of time, during which the baseball is between the rotating belts.

The support plate may be rotated around three axis, x-axis, y-axis, and z-axis. The x-axis runs horizontally along a path roughly parallel to the long axis of the belts and between the belts. Rotation around the x-axis (roll) allows the angle of the spin imparted to the ball to be varied. The y-axis is vertical and rotation around the y axis (yaw) allows left and right horizontal adjustment in the direction the ball is propelled. The z-axis is horizontal, but perpendicular to the x-axis. Rotation around the z-axis allows adjustment to the vertical inclination of the trajectory of the ball. Thus, the pitching machine of the present invention may be capable of throwing balls having different predetermined selected trajectories, velocities, and rotational velocities.

A control system may be provided for selecting a predetermined pitch type for each ball to be thrown by the invented pitching machine. The control system may be capable of either increasing or decreasing the rotational speed of either belt or both belts simultaneously. The control system may further be capable of rotating the support plate around the x-axis and rotating the plate around the y-axis. Thus, the control system may be used to select a desired rotational speed of each belt and horizontal position, vertical inclination, and roll position, of the throwing assembly, to enable the invented pitching machine to throw a ball of a predetermined pitch type. The control system may by activated between each ball thrown, so that each consecutive ball thrown may have a different predetermined trajectory, rotation, and velocity, and thus pitch type, without resetting the machine. Therefore, the pitching machine of the present invention is capable of consecutively throwing balls of different pitch types, which may more effectively train batters. The control system may by operated by remote control or it may by programmed to throw a predetermined series of pitches.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, in which:

DESCRIPTION OF THE PREFERRED EMBODIMENTS

The following description is provided to enable any person skilled in the art to make and use the invention and sets forth the best modes presently contemplated by the inventor of carrying out the invention. Various modifications, however, will remain readily apparent to those skilled in the art, since the generic principles of the present invention have been defined herein.

Figure 1A:
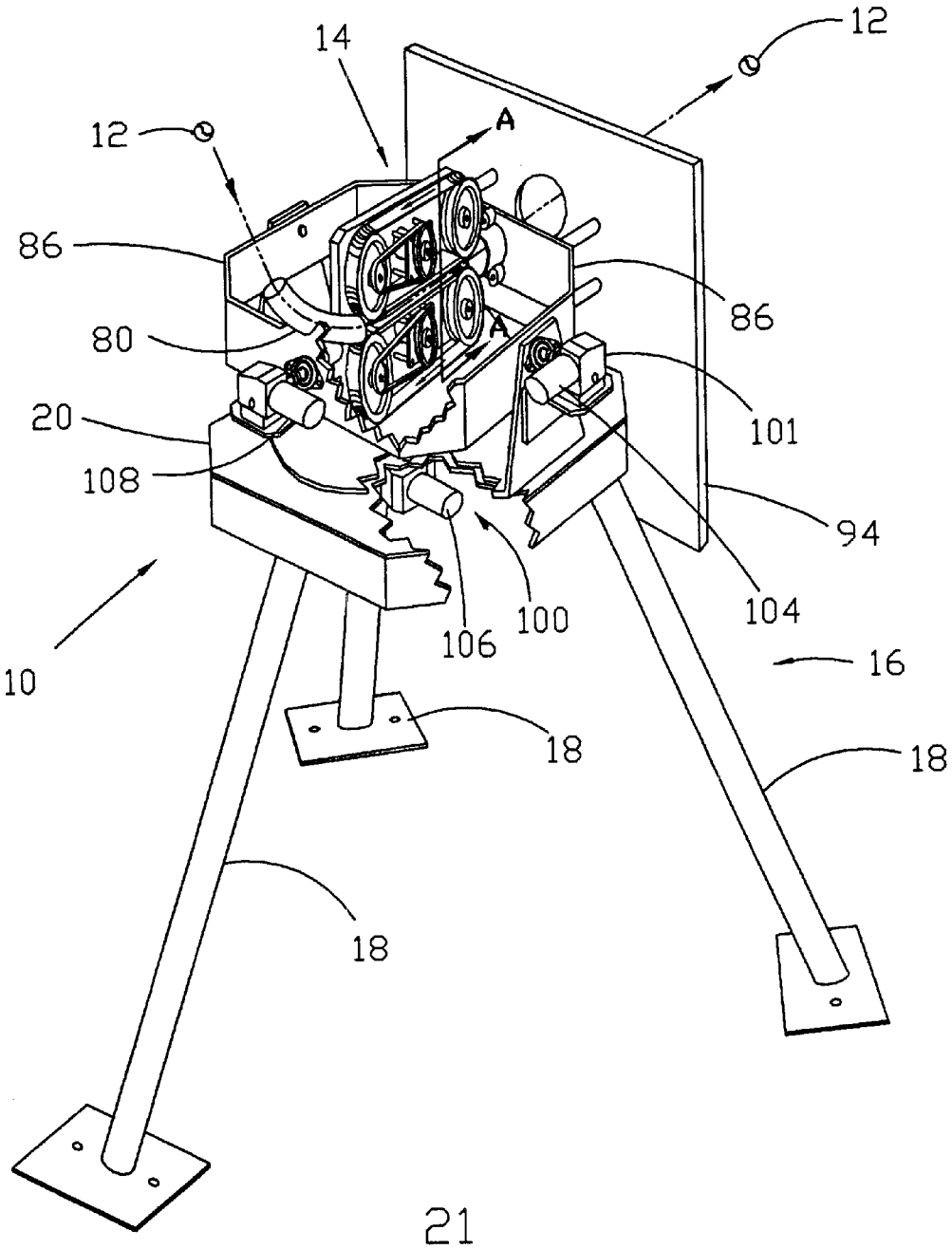
FIG. 1A is a right-rear perspective view showing a preferred embodiment of an improved device for propelling, or throwing balls in a desired direction and at a selected velocity, partially shown in cross-section.
Figure 1B:
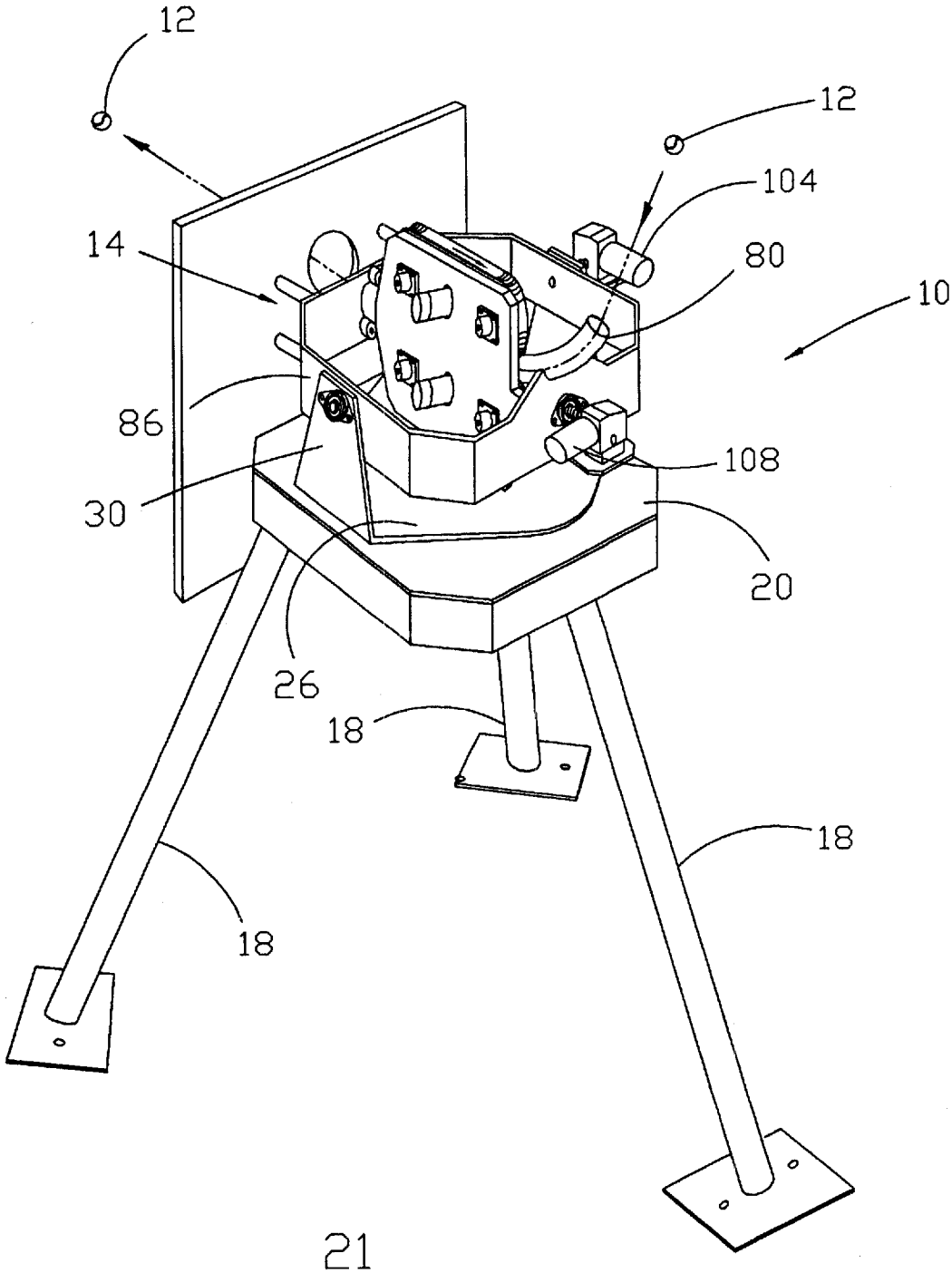
FIG. 1B is a left-rear perspective view showing the preferred embodiment of the present invention.

Referring now to FIGS. 1A and 1B of the drawings, there is shown generally at 10, a first preferred embodiment of an improved device for propelling, or throwing balls in a desired direction and at a selected velocity, commonly known as a pitching machine. The pitching machine 10 of the present invention is capable of consecutively propelling, or throwing, balls 12 each with a different predetermined trajectory, velocity, and rotational velocity, that characterize the pitch type of the ball 12 being thrown, without significantly interrupting a pitch sequence to reset the machine 10.

During an at-bat in a game, a batter does not know what type of pitch is being thrown and cannot pre-adjust their swing and stance for an anticipated speed, trajectory, and location of the pitch. The invented pitching machine 10 may be capable of simulating a pitch sequence, a number of balls thrown with each ball 12 potentially having a different pitch type (different trajectory, rotational velocity, and velocity), as if thrown by a human pitcher during an at-bat in a game situation. Therefore, the invented machine 10 may be capable of effectively training batters.

Referring now to FIGS. 1A, 1B, 2A, and 2B, the drawings, the pitching machine of the present invention 10 includes a pitching assembly, shown generally at 14, that may be pivotably coupled to a support stand 16. The support stand 16 may include a plurality of legs or support members 18, that support a base 20. Preferably, the support members 18 are configured in a known a tripod configuration. Alternatively, the support members 18 may be assembled in other known configurations for supporting the pitching assembly 14 a desired distance above a ground surface 21. In other alternate embodiments, castors or wheels may be secured to the support members 18 to facilitate transporting of the machine 10. The support stand 16 may be fabricated using well known methods and any suitable materials, including wood, plastics, and metal alloys.

A pivot plate 26 may be provided to couple the pitching assembly 14 to the base 20. A plurality of bearings may be interposed between the base 20 and a bottom surface of the pivot plate 26, to provide a bearing surface for the pivot plate 26. The pivot plate 26 may further include a pair of opposed upstanding arms 30 that couple to the pitching assembly 14.

Referring particularly to FIGS. 2A, 2B, and FIGS. 3A, 3B, the pitching assembly 14 may include a ball throwing assembly, shown generally at 50, that includes a support plate 52. The ball throwing assembly 50 may further include a pair of belt assemblies 54A, 54B that are spaced along a vertical y-axis and extend generally parallel to a horizontal x-axis. The support plate 52 may comprise a metal alloy, or other appropriate strong, durable, and rigid material, and may be fabricated using know methods.

Figure 3A:
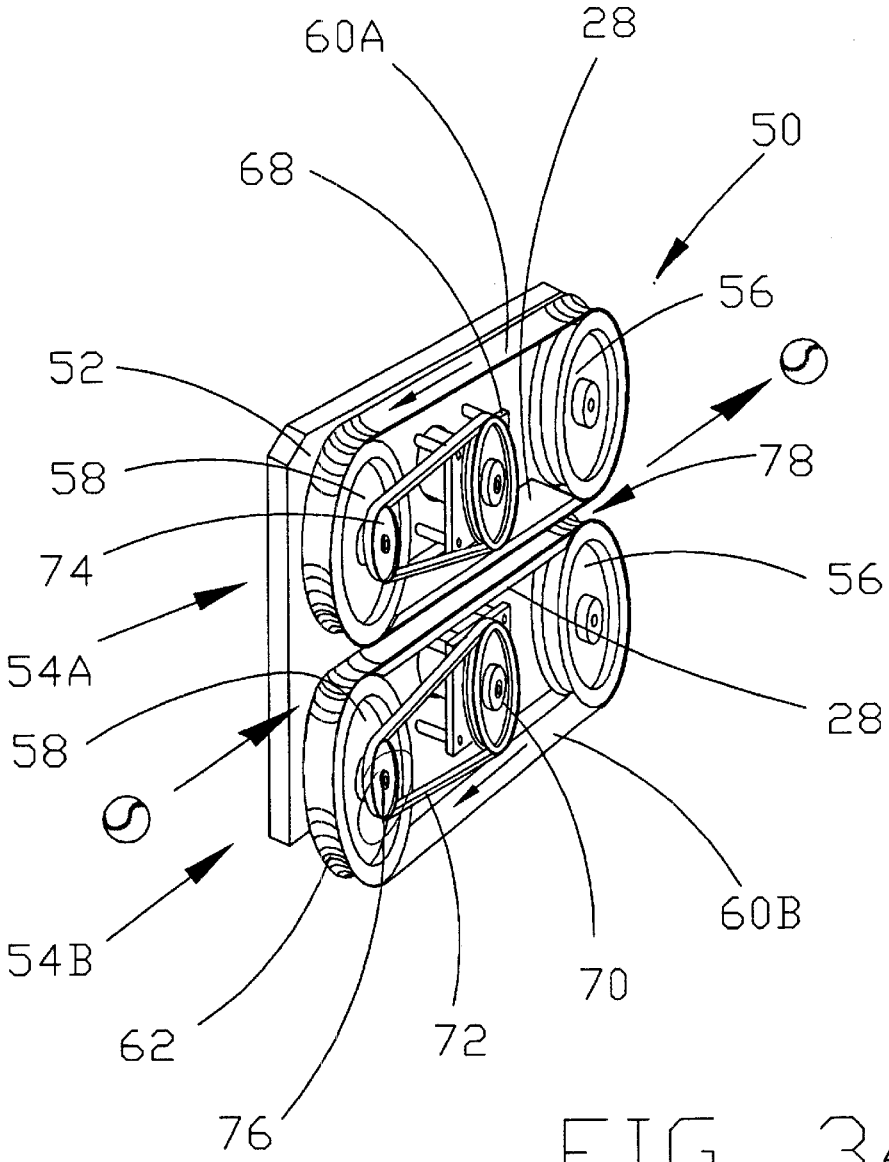
FIG. 3A is a perspective view showing a ball throwing assembly of the preferred embodiment of the improved device of the present invention.
Figure 3C:
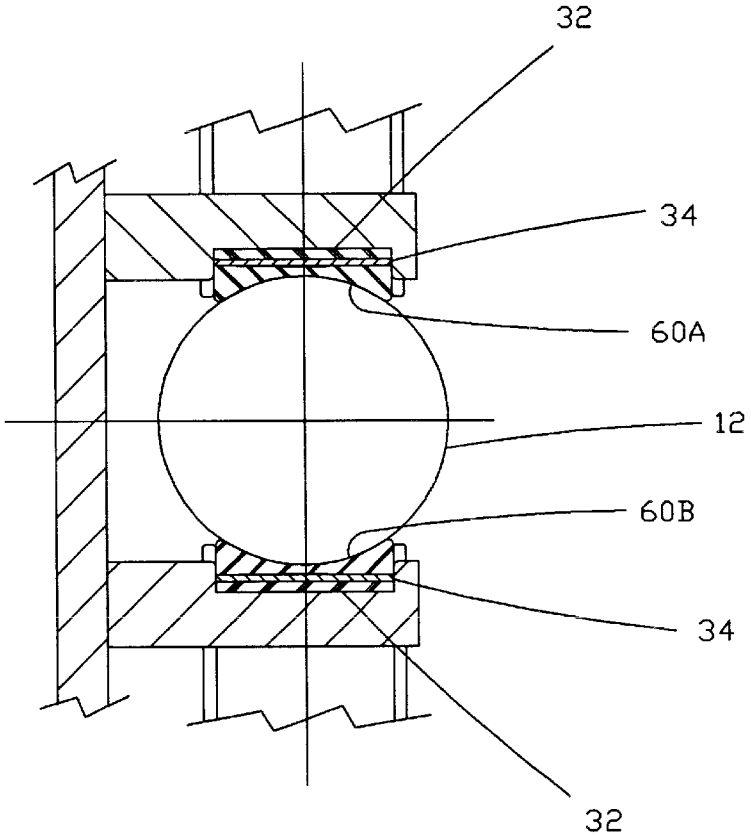
FIG. 3C is a cross section close-up of region C of FIG. 3B.
Figure 3B:
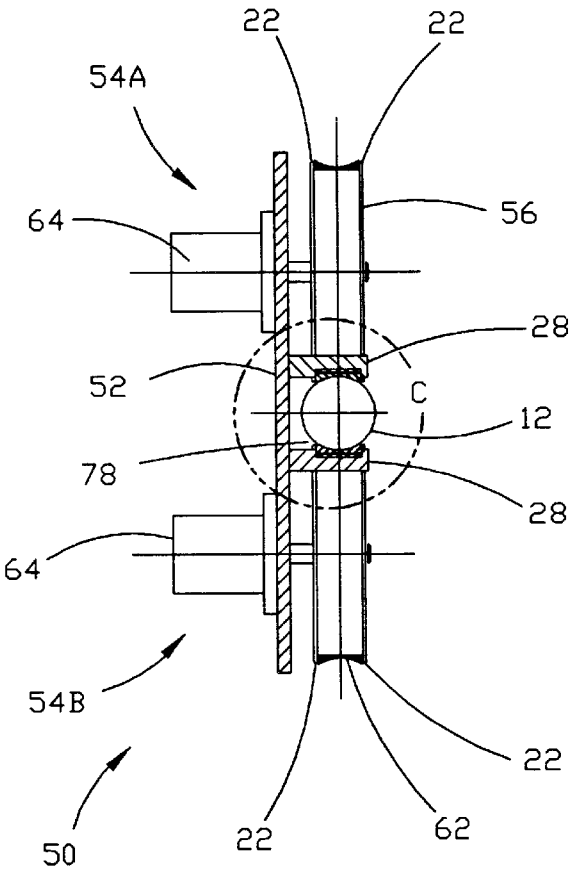
FIG. 3B is a cross-sectional view of the pitching assembly taken along lines A—A of FIG. 1.

Each belt assembly 54A, 54B may include a front pulley 56 and a rear pulley 58 that are coupled to the support plate 52. A belt 60A, 60B that extends around the front and rear pulleys 56, 58 and generally parallel to the x-axis is also provided with each assembly 54A, 54B. In the preferred embodiment, each belt assembly includes a belt guide 28 interposed between the front and rear pulleys 56 and 58. The belt guides 28 preferably include a suspension system that allow the belts 60A, 60B to adjust to small differences it the diameter of the balls 12. Any desired suspension system may be used. A preferred embodiment is best seen in FIG. 3C, which shows the belt guides 28 including a slider plate 32 lying over a compressible material 34. The slider plate 32 is preferably formed of a material selected to provide a low coefficient of friction when contacted by the belts 60A, 60B. The compressible material 34 is preferably be some kind of foam rubber or other similar material, or in alternate embodiments, springs may be used. In use, the belts 60A, 60B run in the grooves of the belt guides 28 on top of the slider plates 32. The suspension assembly allows the belts 60A, 60B to self-adjust vertically to accommodate slightly different ball 12 diameters.

Preferably the front and rear pulleys 56, 58 are configured with a flat periphery, with rims 22 to guide the belts 60A, 60B. The upper surface 62 of the belts 60A, 60B are preferably concave. Each belt assembly 54A, 54B may include a motor 64 (best seen in FIGS. 2B and 3B) that drives, or rotates, at least one of the front pulley 56 and rear pulley 58 at a desired speed for rotating the belt 60A, 60B coupled to the pulley at a predetermined velocity. Preferably, each motor 64 extends through an aperture 66 in the support plate 52 and is secured to the plate 52 by a stand-off bracket 68. Any of a variety of known and commercially available motors 64 may be used. In a preferred embodiment, the motors 64 may comprise commercially available electric motors, such as model 341 manufactured by Applied Industrial Technologies, with preferably a maximum output of approximately 3000 RPM.

Additionally, each motor 64 may have an encoder 65 coupled thereto. The encoder 65 may be provided to enable activation and control of the motor 64 remotely (to be thoroughly discussed further below).

Each motor 64 rotates a drive pulley 70 that may be coupled to one of the front and rear pulleys 56, 58 by means of a drive belt 72. The rear pulley 58 of each belt assembly 54A, 54B includes a hub disk 74 attached to a hub 76 thereof. The drive belt 72 extends about the drive pulley 70 of each motor 64 and the corresponding hub disk 74 of each rear pulley 58 to couple the motor 64 to the respective rear pulley 58 for rotating the pulley and thus driving the belt 60A, 60B coupled thereto. The stand-off bracket or motor mounting 68 aids in aligning the drive pulley 70 with the hub disk 74.

Figure 2A:
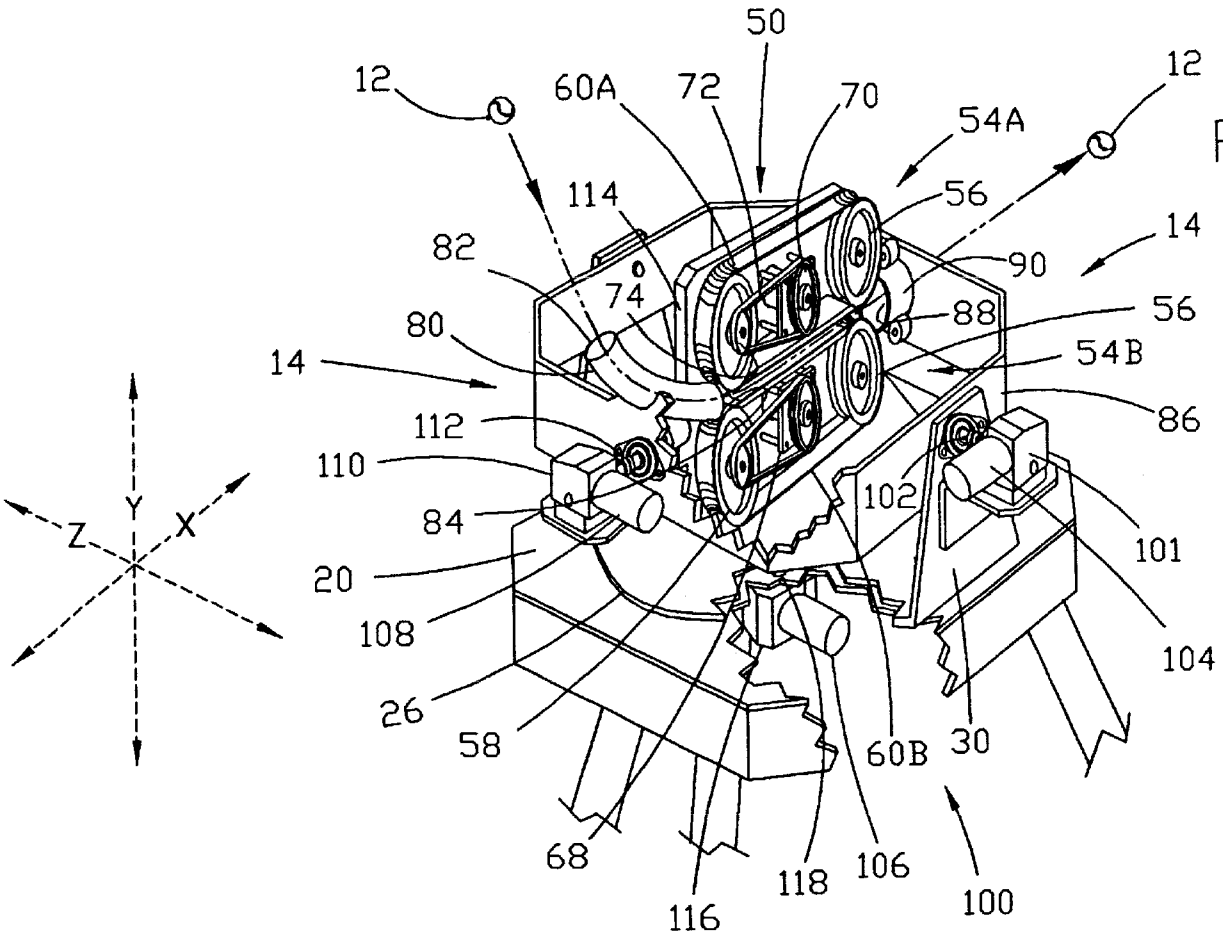
FIG. 2A is a fragmentary right-rear perspective view showing a pitching assembly of the preferred embodiment of the improved device for propelling balls of the present invention, partially shown in cross-section.
Figure 2B:
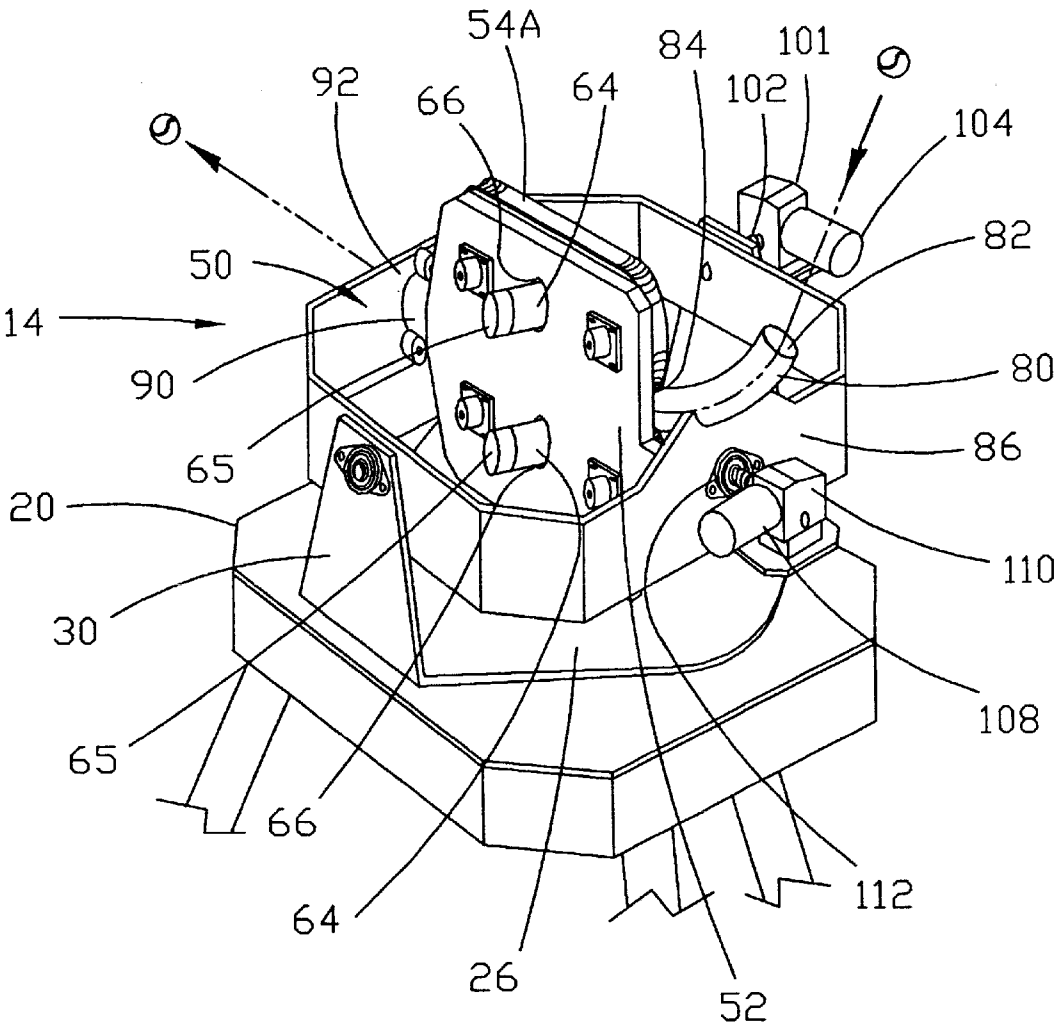
FIG. 2*b* is a fragmentary left-rear perspective view showing a pitching assembly of the preferred embodiment of the improved device for propelling balls in a desired direction of the present invention, partially shown in cross-section.

As shown in FIG. 2A of the drawings, the drive pulley 70 may have a diameter greater than the hub disk 74. However, it is to be understood that the drive pulley 70 and hub disk 74 may be different predetermined diameters relative to one another, so long as a desired efficiency of each motor 64 and selected velocity of belt 60 is achievable.

Alternatively, the front pulley 56 of each belt assembly 54A 54B may be similarly coupled to the motor 64 and driven thereby, as opposed to the rear pulley 58. In a further alternative embodiment, both the front pulley 56 and rear pulley 58 may be coupled to the motor 64 for rotation by the motor 64.

The belt assemblies 54A, 54B are positioned on the support plate 52, so that a space 78 is provided between the two belts 60A, 60B. The space 78 between is dimensioned with a diameter that is slightly less than the diameter of balls 12 to be propelled by the pitching machine 10. Additionally, the concave cross-sectional configuration of the belts 60A, 60B mates with the periphery of balls 12 conveyed thereby, to positively engage the balls 12, and to impart a selected rotational velocity on the balls 12, when it is desired.

Referring again to FIGS. 1A, 2A, and 2B, a ball infeed chute 80 may be provided to feed balls 12 into the space 78 between the two rotating belts 60A, 60B. The infeed chute 80 may comprise an arcuate tube that has an inlet end 82 positioned a distance away from the belt assemblies 54A, 54B and an outlet end 84 positioned adjacent to the rear pulley 58 of each belt assembly 54A, 54B, and aligned with the space 78 to dispose balls 12 into the space 78 between the two rotating belts 60A, 60B. The chute 80 preferably has a diameter greater than balls 12 placed therein. The diameter of the chute 80 allows balls 12 placed in the chute 80 to rapidly pass through the chute 80 and out through the outlet end 84 to be seized between the two rotating belts 60A, 60B adjacent to the rear pulleys 58 of each assembly 54A, 54B.

In use, each ball 12 is seized between the two rotating belts 60A, 60B and rapidly conveyed by the belts 60A, 60B toward the front pulleys 56. The belts 60A, 60B convey the ball 12 at a velocity determined by the speed that each motor 64 rotates the drive pulley 70 coupled thereto for driving the corresponding rear pulley 58. Once the ball 12 reaches point on the belts 60A, 60B, were the belts 60A, 60B diverge from one another and begin extending about the periphery of the front pulleys 56, the ball 12 is propelled, or thrown, in a predetermined direction and at a selected velocity, determined by the velocity of the belts 60A, 60B. A selected one of the belts 60A, 60B may be driven by the corresponding motor 64 at a velocity greater or less than the other belt 60A, 60B. These causes a ball 12 conveyed by the belts 60A, 60B to rotate as it is conveyed.

Inducing a rotational velocity on the ball 12 and increasing or decreasing the rotational velocity thereof, will alter the trajectory of the ball 12 once it is propelled by the machine 10. Since balls 12 are conveyed for a time by the two rotating belts 60A, 60B, a predetermined rotational velocity may be imparted on the balls 12, for throwing a ball with a predetermined trajectory and selected pitch type. Conveyance of balls 12 by the belts 60A, 60B, may reduce wear on balls 12 used by the invented machine 10, and thus increase the life span of the balls 12. Additionally, since balls 12 are conveyed by the belts 60A, 60B for a brief time period, as opposed to being momentarily seized between two wheels, the balls 12 may be more accurately thrown toward a desired target. In alternate embodiments it may be desirable to change the velocity of rotating belts 60A and 60B over time as the ball 12 travels from adjacent the rear pulleys 58 toward the front pulleys 56.

The pitching assembly 14 further includes a box 86 that extends around the periphery of the pitching assembly 14. The box 86 is pivotally attached to the upstanding arm 30 of the pivot plate 26. The pivotal attachment of the box 86 to the pivot plate's 26 upstanding arms 30 allows the box to tilt up or down and thereby change the vertical angle of trajectory of a thrown ball. Also, the support plate 52 is pivotally attached to the box 86. The pivotal attachment of the support plate 52 to the box 86 allows the support plate 52 to tilt side to side and thereby change the curve or the rotational direction of a thrown ball with respect to the path between the pitching machine and person hitting. Additionally, the box 86 is configured with an aperture 88 to allow balls propelled by the ball throwing assembly 50 to pass through the box 86. An annular guide 90 may be affixed to an inner surface 92 of the box 86 and around the periphery of the aperture 88, such that the annular guide 90 extends inwardly toward the space 78 between the two rotating belts 60A, 60B and adjacent to the front pulley 56 of each belt assembly 54A, 54B. The annular guide 90 has a diameter greater than balls 12 propelled by the machine 10.

A shield 94 is coupled to the box 86 to prevent hit balls 12 from striking and damaging the pitching assembly 14. The shield 94 may also obscure a batters view of the pitching assembly 14, so that he or she is unable to predict the pitch type of the ball 12 to be thrown by the machine 10 based on observation or the orientation of the pitching assembly 14. The shield 94 may be any suitable configuration that extends around the periphery of the pitching assembly 14 such as rectangular or any other appropriate configuration, and includes an aperture aligned with the aperture 88 of the box 86 for the ball 12 to pass through. The shield 94 preferably comprises a material that is sufficiently rigid to prevent hit balls 12 that strike the shield 94 from damaging the pitching assembly 14. The shield 94 may comprise a lightweight, rigid, and durable metal alloy or other acceptable material.

In the preferred embodiment, a control system may be provided for selecting a predetermined pitch type for each ball 12 to be thrown by the invented pitching machine 10. The control system controls the rotation of the support plate 52 around the x-axis, y-axis, and z-axis (shown in dotted lines in FIG. 2A) for propelling balls 12 at a desired target. The control system may also be activated to adjust the velocity of the rotating belts 60A, 60B to enable the ball throwing assembly 50 to throw balls 12 with a selected velocity. The control system 100 may further be activated for adjusting the velocity of one of the rotating belts 60A, for example, relative to the other belt 60B, for example, to induce a rotational velocity on the ball 12 and for increasing or decreasing the rotational velocity thereof.

The control system may include a number of preferably electromechanical devices that are activated to rotate the pitching assembly 14 around the y-axis, x-axis, and z-axis. In a preferred embodiment, the control system includes a first electromechanical device which preferably comprises a step motor 104 and gear box 101, that has a shaft 102 that extends through the upstanding arm 30 to contact the box 86. Referring to FIG. 2A, the motor 104 is activated to rotate the shaft 102 either clockwise or counterclockwise to rotate a pitching assembly box 86 containing the pitching assembly 14, around the z-axis to achieve a desired vertical inclination. A second electromechanical device preferably comprises a second step motor 108 and gear box 110, with a shaft 112 that extends though the box 86 and is attached to a rear edge 114 of the support plate 52. The second motor 108 may be activated to rotate the shaft 112 either clockwise or counterclockwise in order to rotate the pitching assembly 14 around the x-axis to achieve a desired inclination of the spin applied to the ball. A third electromechanical device preferably comprises a step motor 106 and gear box 116 with a shaft 118 that extends though the base 20 and is affixed to the bottom surface 29 of the pivot plate 26. The motor 106 may be activated to rotate the shaft 118 either clockwise or counterclockwise around the y-axis to pivot the assembly 14 about on the base 20, i.e. pivoting the assembly 14 left and right right. Each of the step motors 104, 106, 108 may have a power source coupled thereto and to a control system that may include an onboard computer, or transceiver to enable control of the motor by a remote device.

Figure 4B:
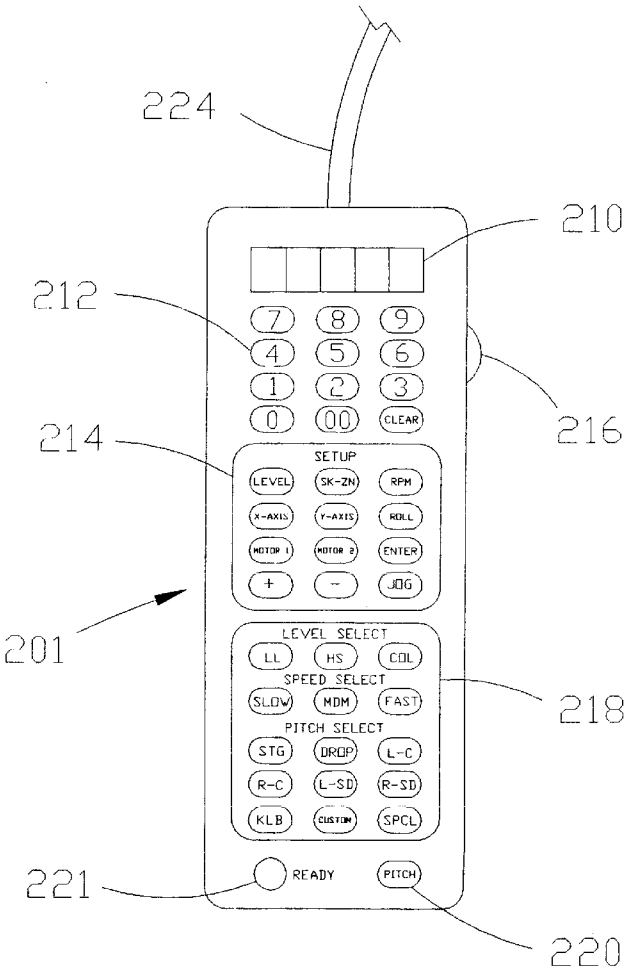
FIGS. 4A and 4B are schematic views showing remote control devices of the improved device for propelling balls of the preferred embodiment of present invention.
Figure 4A:
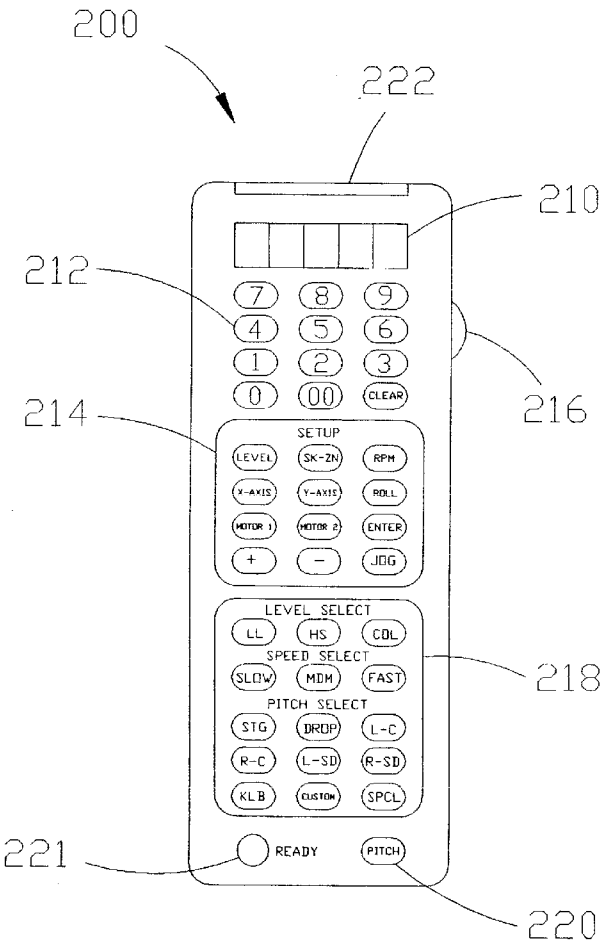

Referring to FIG. 4A there is shown a first embodiment of a hand-held remote control device 200 and a second embodiment of a hand-held remote control device 201 is shown in FIG. 4B. Referring to FIGS. 4A and 4B, each remote control device 200, 201 preferably includes a Liquid Crystal Diode (LCD) display 210, a numeric keypad 212, a set-up keypad 214, an ON/OFF switch 216, a pitch selection keypad 218, a start pitch button 220, and a READY light 221. In the first embodiment, the remote control device 200 communicates with the transceivers of each motor 104, 106, 108 and or the on board computer via an infrared transmitter 222. In the second embodiment, the remote control device 201 communicates with the transceivers of each motor 104, 106, 018, and or an on board computer via a cable 224. Each of the remote control devices 200, 201 are constructed using methods and materials well known in the art and contain circuitry that enable the particular functionalities thereof.

In use, an initial setup of the invented machine 10 is performed and the control system 100 is programmed to throw each pitch in the pitch select mode. Once the machine 10 is at an installation site, a user must first level the machine 10. The LEVEL button is first pressed, then the Y-AXIS button is depressed for adjusting the machine 10 vertically. The plus (+) or minus (−) buttons may then be pressed to adjust the machine 10 vertically. This procedure is repeated for adjusting the pitching machine 10 horizontally.

The user then must indicate to the machine 10 where a desired target, such as a desired strike zone, is located. This is performed by first measuring the distance to the target, which may be a home plate for example, and establishing desired parameters of the strike zone. The control system 100 is then activated to throw a few balls 12 towards the target and in the strike zone.

If the balls 12 are wide of the target, either left or right, the x-axis is adjusted by first depressing the SK-ZN button, then the X-AXIS button. The plus (+) or minus (−) buttons may then be pressed and then the JOG button is repeatedly pressed to adjust the machine 10 horizontally as necessary. If the balls 12 are too high or too low of the target, the y-axis is adjusted by first depressing the SK-ZN button, then the Y-AXIS button. The plus (+) or minus (−) buttons may then be pressed and then the JOG button is repeatedly pressed to adjust the machine 10 vertically as necessary.

Once the desired location of the balls 12 has been achieved, the selection for each pitch type is tested. If correction of a selected pitch type is required, the above-described procedures can be repeated for each pitch type. If the spin of a curve ball, for example, requires adjustment, the speed of the ball throwing assembly's motors 64 may be adjusted. The button for the appropriate motor is first depressed, then plus (+) or minus (−) buttons may then be pressed and then the JOG button is repeatedly pressed to adjust the machine 10 to increase or decrease the velocity of the corresponding belt 60A, 60B as necessary. Once the desired velocity of the belt 60A, 60B is achieved, the ENTER button is pressed to store in memory the desired velocity.

A custom pitch type is created by first pressing the CUSTOM button. Then the category of the pitch is selected. Next, the desired horizontal and vertical inclinations and speeds of the belts 60A, 60B are selected. The created pitch is then assigned a three-digit number that is entered with the numeric keypad 212.

Upon completion of these set-up procedures, the invented pitching machine 10 is capable of throwing balls 12 of programmed pitch types including fastballs, curveballs, sliders, knuckle-balls, and change-ups, for example. The remote control unit 200, 201 is activated by pressing any button located in the pitch selection keypad 218. Once such a pitch is selected, it will be delivered to the hitter. A different pitch selection button may be pressed for each consecutive ball 12 thrown, so that each consecutive ball 12 thrown may have a different predetermined trajectory, rotation, and velocity, thus the pitch type. Additionally or alternatively, the invention may include a memory means, such as a memory chip, capable of storing a string or series of preprogrammed pitches that are executed sequentially or in a random order.

Thus, there has been described an improved pitching machine. The invented pitching machine may be capable of consecutively throwing balls that each have a different predetermined trajectory, rotational velocity, and velocity, without resetting the machine. The machine may be capable of simulating a pitch sequence, as thrown by a pitcher in a game situation, which may effectively train batters. The velocity of the belts may be independently adjusted for throwing balls of different predetermined trajectories. The control system is used to select the velocity of each belt and horizontal and vertical inclination of the belts to enable the machine to throw balls of selected pitch types. The control system can be activated between each thrown ball, so that each consecutive ball thrown may have a different pitch type.

Those skilled in the art will appreciate that various adaptations and modifications of the just-described preferred embodiments can be configured without departing from the scope and spirit of the invention. Therefore, it is to be understood that, within the scope of the appended claims, the invention may be practiced other than as specifically described herein.

What is claimed is:

1. A device for propelling balls comprising:

a pair of spaced belt assemblies that extend generally parallel to one another and along a horizontal axis, each belt assembly including a pair of spaced pulleys with a belt having an outer surface that is concave in cross section extending around both pulleys and generally parallel to the horizontal axis and a motor that drives at least one pulley for rotating the belt;

a ball infeed chute positioned to dispose balls into a space between the two belts, the belts seizing a ball disposed in the space to propel the ball; and a control system for adjusting the velocity of at least one of the belts.

2. The device of claim 1 wherein the control system adjusts the velocity of at least one of the belts to enable the device to propel a ball in a predetermined direction and at a selected velocity.

3. The device of claim 2 wherein the control system adjusts the velocity of one of the belts relative to the other belt to impart a rotational velocity on a ball conveyed by the belts for propelling the ball along a predetermined trajectory.

4. The device of claim 1 wherein the belt assemblies may be rotated about the horizontal axis for propelling a ball in different predetermined directions.

5. The device of claim 1 wherein the control system is located remotely to the device.

6. The device of claim 5 wherein the control system is portable.

7. A device for propelling balls comprising:

a pair of spaced belt assemblies extending generally parallel to one another and along a horizontal axis, each belt assembly including a pair of spaced pulleys with a belt having an outer surface that is concave in cross section extending around both pulleys and generally parallel to the horizontal axis such that a space is provided between the two belts, each belt assembly further including a motor that drives at least one pulley for rotating the belt coupled thereto at a selected velocity;

a ball infeed chute positioned to dispose balls into the space between the two belts, upon rotation of the belts, the belts seizing a ball disposed therebetween to propel the ball in a predetermined direction and at a selected velocity; and a control system for adjusting the velocity, direction, and rotational velocity of balls propelled by the device, the control system activated to adjust the velocity of each of the belts and to rotate the belt assemblies about the horizontal axis to propel the ball in the predetermined direction, at the selected velocity, and along a predetermined trajectory.

8. The device of claim 7 wherein the control system is activated to adjust the velocity of each belt for each subsequent ball propelled by the device.

9. The device of claim 8 wherein the control system is activated to rotate the belt assemblies about the horizontal axis for each subsequent ball propelled by the device.

10. The device of claim 7 wherein the control system is activated to rotate the belt assemblies about the vertical axis.

11. The device of claim 10 wherein the control system is activated to rotate the belt assemblies about the vertical axis for each subsequent ball propelled by the device.

12. The device of claim 7 wherein the control system is activated to adjust the velocity of each belt to a predetermined velocity and to rotate the belt assemblies to a predetermined horizontal and vertical inclination, so that the device propels a ball with a trajectory characteristic of a desired pitch.

13. The device of claim 7 wherein the control system is activated between each ball propelled to adjust the velocity of each belt to another predetermined velocity and to rotate the belt assemblies to another predetermined horizontal inclination and to another predetermined vertical inclination, so that the device propels balls of different pitch types for each subsequent ball propelled.

14. The device of claim 7 wherein the control system is located remotely to the device.

15. The device of claim 14 wherein the control system is portable.

16. The device of claim 7 further includes a screen extending about the periphery of the belt assemblies.

17. The device of claim 16 wherein the screen is configured with an aperture to allow balls propelled by the belt assembly to pass through the screen, the screen sufficiently rigid to inhibit balls striking the screen from damaging the belt assemblies.

18. The device of claim 7 further including a support stand for supporting the device a predetermined distances above a surface.

19. The device of claim 18 wherein the device is rotatably coupled to the support stand.

20. The device of claim 7, further including a belt guide disposed between each pair of pulleys.

* * * * *